US005950520A

United States Patent [19]

Kurosawa

[11] Patent Number: 5,950,520

[45] Date of Patent: Sep. 14, 1999

[54] SWASH PLATE COMPRESSOR

[75] Inventor: Juetsu Kurosawa, Namekawa-machi, Japan

[73] Assignee: Zexel Corporation, Tokyo, Japan

[21] Appl. No.: 09/042,925

[22] Filed: Mar. 17, 1998

[30] Foreign Application Priority Data

Mar. 25, 1997 [JP] Japan ..... 9-091455

[51] Int. Cl.[6] ..... F01B 13/04

[52] U.S. Cl. ..... 92/12.2; 92/57; 92/71; 417/269

[58] Field of Search ..... 417/269; 92/12.2, 92/57, 71

[56] References Cited

U.S. PATENT DOCUMENTS 4,732,545 3/1988 Ohta et al. ..... 417/269 X
4,846,049 7/1989 Terauchi ..... 92/12.2
4,979,877 12/1990 Shimizu ..... 417/269 X
5,046,927 9/1991 Ohno et al. ..... 417/269 X
5,239,913 8/1993 Terauchi ..... 92/12.2 X

*Primary Examiner*—Hoang Nguyen
*Attorney, Agent, or Firm*—Frishauf, Holtz, Goodman, Langer & Chick, P.C.

[57] ABSTRACT

A swash plate compressor includes a plurality of shoes each arranged on a sliding surface of a swash plate, for relative rotation with respect to a circumference of the swash plate as the drive shaft rotates, a retainer mounted on the swash plate in a relatively rotatable manner with respect to the swash plate, for retaining the shoes, and a retainer support member rigidly fitted on the swash plate, for slidably supporting the retainer. The swash plate compressor has a sliding plate interposed between the retainer and the retainer support member in a slidable manner with respect to both of the retainer and the retainer support member.

10 Claims, 5 Drawing Sheets

SWASH PLATE COMPRESSOR

BACKGROUND OF THE INVENTION

1. Field of the Invention

This invention relates to a swash plate compressor, and more particularly to a swash plate compressor having a construction which is capable of reducing abrasion of a retainer for retaining shoes.

2. Description of the Prior Art

A conventional variable capacity swash plate compressor includes a thrust flange rigidly fitted on a drive shaft, for rotation in unison with the drive shaft, a swash plate mounted on the drive shaft in a tiltable manner with respect to an imaginary plane perpendicular to the drive shaft, for rotation in unison with the thrust flange as the thrust flange rotates, a plurality of shoes performing relative rotation on a sliding surface of the swash plate with respect to the circumference of the swash plate, respectively, as the drive shaft rotates, a retainer mounted on the swash plate in a relatively rotatable manner with respect to the swash plate, for retaining the shoes, and a retainer support member rigidly fitted on the swash plate, for slidably supporting the retainer.

Torque of an engine, not shown, installed on an automotive vehicle, not shown, is transmitted to the drive shaft to rotate the same. Torque of the drive shaft is transmitted from the thrust flange to the swash plate via a linkage to cause rotation of the swash plate about the drive shaft.

As the swash plate rotates, the shoes perform relative rotation on the sliding surface of the swash plate with respect to the circumference of the swash plate, whereby torque transmitted from the swash plate is converted into reciprocating motion of each piston.

As a piston reciprocates within the cylinder bore, the volume of a compression chamber within the cylinder bore changes, whereby suction, compression and delivery of refrigerant gas are sequentially carried out in the compression chamber.

In this process, when the piston moves from a top dead center position of the swash plate to a bottom dead center position of the same as the swash plate rotates, the piston is pulled by the retainer, and the retainer is pressed against the retainer support member.

In the meantime, the retainer support member rotates in unison with the swash plate, whereas the retainer does not rotate in unison with the swash plate, but performs relative rotation or sliding with respect to the retainer support member.

Therefore, if the retainer support member is formed of a ferrous material, while the retainer is formed of an aluminum-based material, a sliding surface of the retainer easily wears, so that a gap is produced between the retainer and the retainer support member. As a result, noise is produced from the two component parts of the compressor whenever the piston reciprocates within the cylinder bore.

SUMMARY OF THE INVENTION

It is an object of the invention to provide a swash plate compressor having a construction which is capable of reducing abrasion of a sliding surface of a retainer to thereby prevent occurrence of noises.

To attain the above object, the present invention provides a swash plate compressor including a drive shaft, a rotating member rigidly fitted on the drive shaft, for rotation in unison with the drive shaft as the drive shaft rotates, a swash plate mounted on the drive shaft in an inclined manner with respect to an imaginary plane perpendicular to the drive shaft, the swash plate having a sliding surface and rotating in unison with the rotating member as the rotating member rotates, a plurality of shoes each arranged on the sliding surface of the swash plate, for relative rotation with respect to a circumference of the swash plate as the drive shaft rotates, a retainer mounted on the swash plate in a relatively rotatable manner with respect to the swash plate, for retaining the shoes, and a retainer support member rigidly fitted on the swash plate, for slidably supporting the retainer.

The swash plate compressor according to the present invention is characterized by comprising a sliding plate interposed between the retainer and the retainer support member in a manner slidable with respect to both of the retainer and the retainer support member.

According to the swash plate compressor of the invention, since the sliding plate is interposed between the retainer and the retainer support member in a slidable manner with respect to both of the retainer and the retainer support member, sliding speed at which the retainer and the retainer support member slide with respect to each other is decreased, i.e. decomposed into two slower components found on opposite sides of the sliding part whereby abrasion of the retainer is reduced.

Preferably, at least one of the retainer and the retainer support member is formed with a recess for receiving the sliding plate therein.

According to the preferred embodiment, since the sliding plate is received within the recess formed in at least one of the retainer and the retainer support member, it is not required to align the sliding plate with the retainer when the sliding plate is mounted.

Preferably, the sliding plate is formed by blanking.

More preferably, the recess is formed in the retainer.

Further preferably, the retainer is in the form of an annular disk having a retainer support member-side end face, the recess is annularly formed in the retainer support member-side end face along an inner periphery thereof.

Still more preferably, the recess has a diameter substantially as large as an outer diameter of the sliding plate and a depth substantially as large as a thickness of the sliding plate.

Preferably, the sliding plate is formed of a ferrous material.

The above and other objects, features and advantages of the present invention will become more apparent from the following detailed description taken in conjunction with accompanying drawings.

DETAILED DESCRIPTION OF THE PREFERRED EMBODIMENT

The invention will now be described in detail with reference to drawings showing a preferred embodiment thereof.

Figure 1:
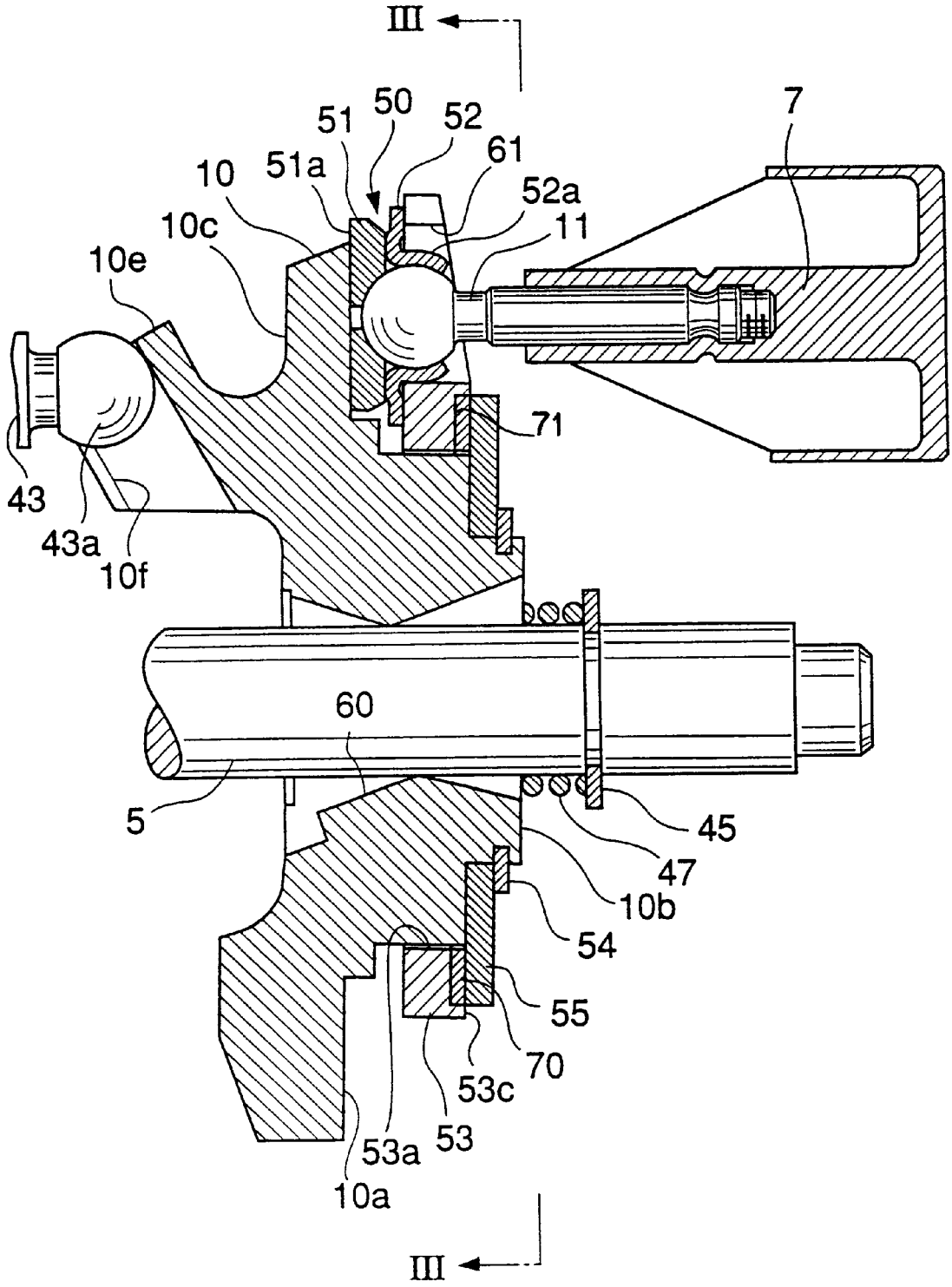
FIG. 1 is an enlarged partial view, partly in section, showing essential parts of a variable capacity swash plate compressor according to an embodiment of the invention.
Figure 2:
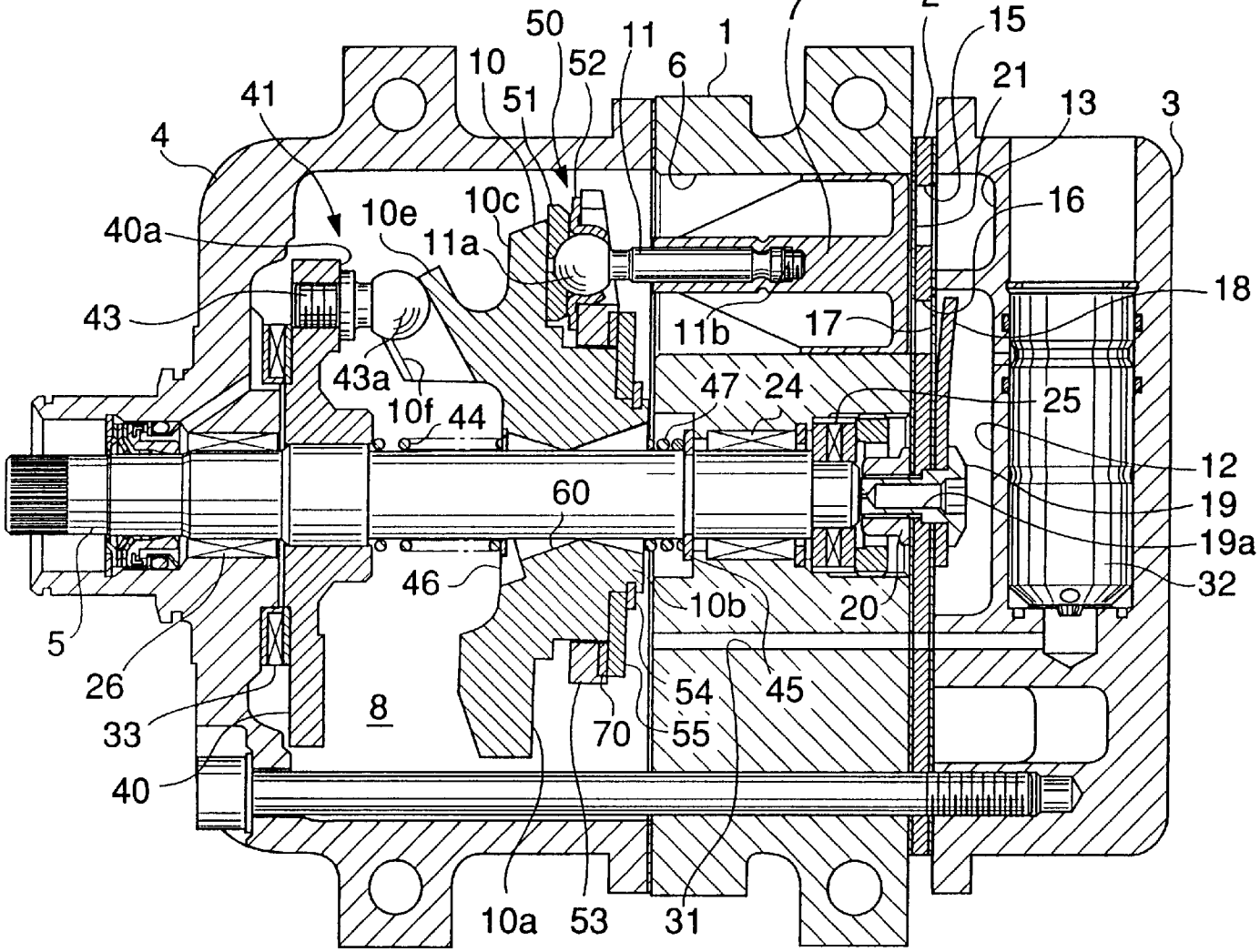
FIG. 2 is a longitudinal cross-sectional view showing the whole arrangement of the variable capacity swash plate compressor according to the embodiment of the invention.

FIG. 2 shows the whole arrangement of a variable capacity swash plate compressor according to an embodiment of the invention, and FIG. 1 shows essential parts of the compressor on an enlarged scale.

The variable capacity swash plate compressor has a cylinder block 1 having one end thereof secured to a rear head 3 via a valve plate 2 and the other end thereof secured to a front head 4. The cylinder block 1 has a plurality of cylinder bores 6 axially extending therethrough at predetermined circumferential intervals about a drive shaft 5. Each cylinder bore 6 has a piston 7 slidably received therein.

The front head 4 defines therein a crankcase 8 in which a swash plate 10 is received, for rotation in unison with the drive shaft 5. A plurality of shoes 50 are each respectively connected to a spherical end 11*a* of a corresponding one of connecting rods 11 in a relatively slidable manner with respect to the shoe 50. The shoes 50 are retained on a sliding surface 10*a* of the swash plate 10 by a retainer 53. The retainer 53 is mounted on a boss 10*b* of the swash plate 10 in a manner slidably supported or held by a retainer support member 55 rigidly fitted on the boss 10*b* of the swash plate 10. A shim (sliding plate) 70, referred to hereinafter, is interposed between the retainer 53 and the retainer support member 55. The connecting rod 11 has the other end portion 11*b* thereof secured to a corresponding one of the pistons 7.

Each of the shoes 50 is comprised of a first support member 51 for supporting a front surface of the one spherical end 11*a* of a corresponding one of the connecting rods 11 such that the one spherical end 11*a* of the connecting rod 11 is relatively rotatable with respect to the first support member 51 and a second support member 52 for supporting or retaining a rear surface of the one end 11*a* of the same such that the rear surface of the one end 11*a* of the same is relatively rotatable with respect to the second support member 52.

Within the rear head 3, there are formed a discharge chamber 12 and a suction chamber 13 surrounding the discharge chamber 12.

The valve plate 2 is formed with refrigerant outlet ports 16 for each communicating between a compression chamber within a corresponding one of the cylinder bores 6 and the discharge chamber 12, and refrigerant inlet ports 15 for each communicating between a compression chamber within a corresponding one of the cylinder bores 6 and the discharge chamber 12. The refrigerant outlet ports 16 and the refrigerant inlet ports 15 are arranged at predetermined circumferential intervals about the drive shaft 5. The refrigerant outlet ports 16 are opened and closed by respective discharge valves 17 formed as a unitary member. The unitary member of the discharge valves 17 is fixed to a rear head-side end face of the valve plate 2 by a bolt 19 and nut 20 together with a valve stopper 18.

On the other hand, the refrigerant inlet ports 15 are opened and closed by respective suction valves 21 formed as a unitary member arranged between the valve plate 2 and the cylinder block 1. The bolt 19 has a guide hole 19*a* for guiding high-pressure refrigerant gas from the discharge chamber 12 to a radial bearing 24 and a thrust bearing 25.

A rear end of the drive shaft 5 is rotatably supported by the radial bearing 24 and the thrust bearing 25, while a front end of the drive shaft 5 is rotatably supported by a radial bearing 26.

A communication passage 31 is formed between the suction chamber 13 and the crankcase 8 for communication therebetween, and a pressure control valve 32 is provided at an intermediate portion of the communication passage 31 for controlling pressure within the suction chamber 13 and pressure within the crankcase 8.

The drive shaft 5 has a thrust flange (rotating member) 40 rigidly fitted on a front portion thereof for transmitting torque of the drive shaft 5 to the swash plate 10. The thrust flange 40 is rotatably supported on an inner wall of the front head 4 by a thrust bearing 33. The thrust flange 40 and the swash plate 10 are connected with each other via a linkage 41. The swash plate 10 can tilt with respect to an imaginary plane perpendicular to the drive shaft 5.

The linkage 41 is comprised of a bracket 10*e* formed on a front surface 10*c* of the swash plate 10, a linear guide groove 10*f* formed in the bracket 10*e*, and a rod 43 screwed into a swash plate-side surface 40*a* of the thrust flange 40. The longitudinal axis of the guide groove 10*f* is inclined at a predetermined angle with respect to the front surface 10*c* of the swash plate 10. The rod 43 has one spherical end 43*a* thereof slidably fitted in the guide groove 10*f*.

The swash plate 10 has a central through hole 60 through which the drive shaft 5 extends. The swash plate 10 is axially slidably fitted on the drive shaft 5 in a tiltable manner with respect to the imaginary plane perpendicular to the drive shaft 5. On the drive shaft 5 is fitted a coil spring 44 between the thrust flange 40 and the swash plate 10 to urge the swash plate 10 toward the cylinder block 1. Further, the drive shaft 5 has a stopper 45 fitted thereon, and a coil spring 47 is fitted on the drive shaft 5 between the stopper 45 and the swash plate 10 to urge the swash plate 10 toward the thrust flange 40.

Figure 3:
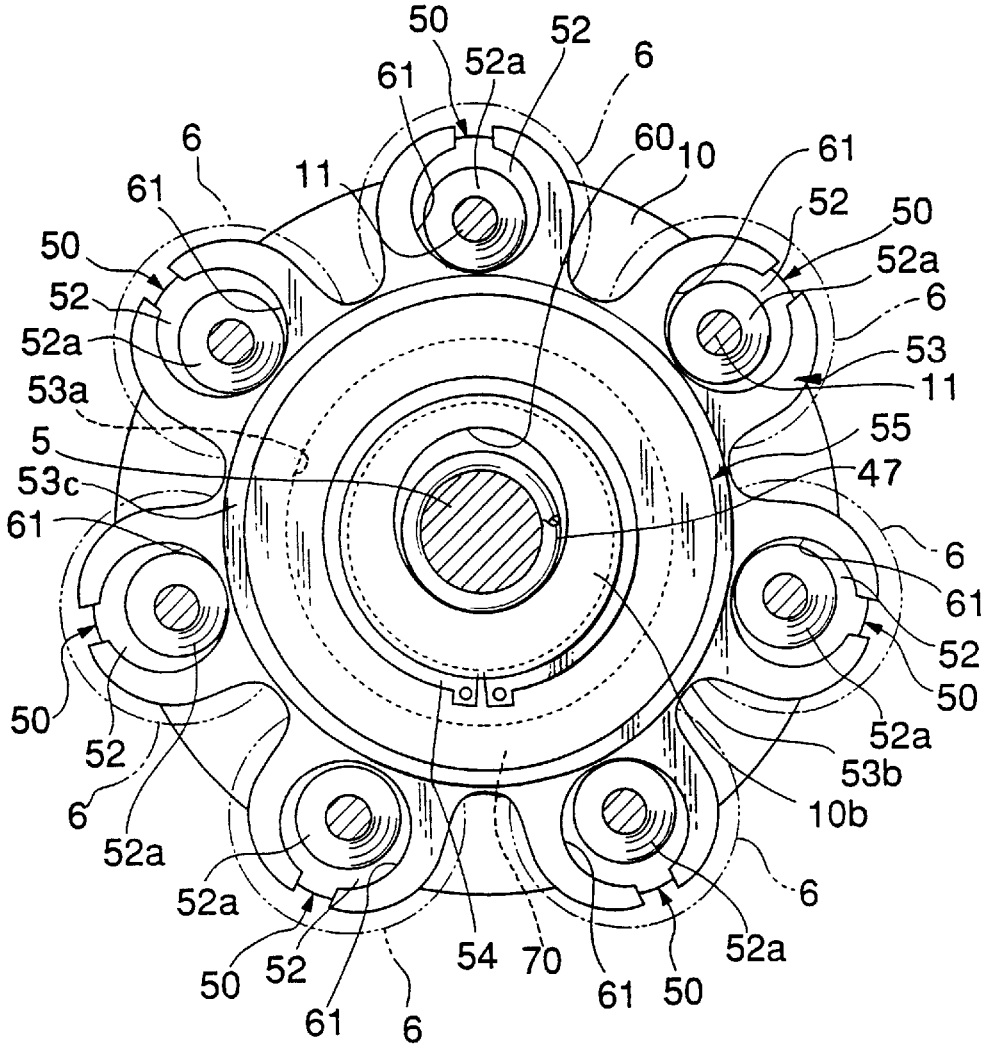
FIG. 3 is a view taken on line III—III of FIG. 1.
Figure 4:
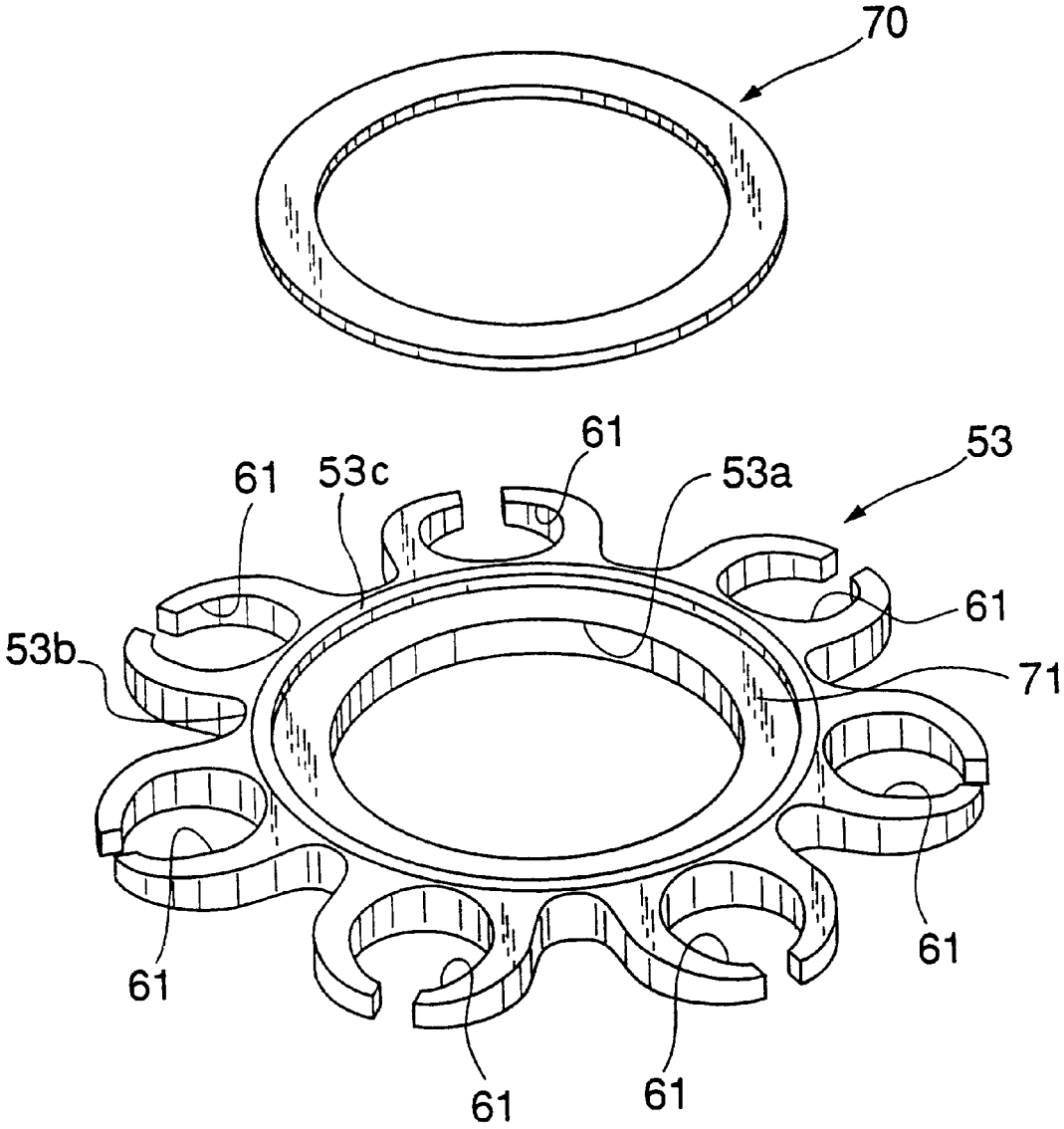
FIG. 4 is an exploded perspective view showing a retainer and a shim.

FIG. 3 shows the retainer 53, the shim 70 and other component parts associated therewith, taken on line III—III of FIG. 1, while FIG. 4 shows the retainer 53 and the shim 70, in an exploded state.

The shim 70 is in the form of an annular disk having an outer diameter substantially as large as that of the retainer support member 55. The shim 70 is formed by blanking a steel plate (ferrous material).

The retainer 53 is formed of an aluminum-based material, and the diameter thereof is larger than that of the shim 70. The retainer 53 is formed by an annular portion 53*b* having a central through hole 53*a* through which the boss 10*b* of the swash plate 10 is fitted and a plurality of broken semi-annular portions formed along the circumference thereof through each of which a protruding portion 52*a* of each shoe 50 protrudes toward the piston 7 (see FIG. 1). The retainer support member 55 is formed of a ferrous material.

The retainer 53 has a piston-side surface 53*c* formed therein with an annular recess 71 in which the shim 70 is received. The recess 71 has a diameter substantially as large as the outer diameter of the shim 70 and a depth thereof substantially as large as the thickness of the shim 70.

Next, the operation of the variable capacity swash plate compressor constructed as above will be described.

Torque of an engine, not shown, installed on an automotive vehicle, not shown, is transmitted to the drive shaft 5 to rotate the same. Torque of the drive shaft 5 is transmitted to the swash plate 10 via the thrust flange 40 and the linkage 41 to cause rotation of the swash plate 10.

When the swash plate 10 is rotated, the shoes 50 slide along the sliding surfaces 10*a*. Because of the angle that the swash plate 10 forms with the imaginary plane perpendicular to the drive shaft 5, the torque transmitted from the swash plate 10 is converted into the reciprocating motion of each piston 7. As the piston 7 reciprocates within the cylinder bore 6 associated therewith, the volume of a compression chamber within the cylinder bore 6 changes. As a result, suction, compression and delivery of refrigerant gas are sequentially carried out in the compression chamber, whereby high-pressure refrigerant gas is delivered from the compression chamber in an amount corresponding to the inclination of the swash plate 10. During the suction stroke, the suction valve 21 opens to draw low-pressure refrigerant gas from the suction chamber 13 into the compression chamber within the cylinder bore 6. During the discharge stroke of the corresponding piston 7, the discharge valve 17 opens to deliver high-pressure refrigerant gas from the compression chamber to the discharge chamber 12.

When thermal load on the compressor decreases, the pressure control valve 32 closes the communication passage 31, whereby pressure within the crankcase 8 is increased to decrease the inclination of the swash plate 10. As a result, the length of stroke of the piston 7 is decreased to reduce the delivery quantity or capacity of the compressor. In the meantime, the one spherical end 43*a* of the rod 43 of the linkage 41 slides along the guide groove 10*f* to one end of the same.

When the thermal load on the compressor increases, the pressure control valve 32 opens the communication passage 31, whereby the pressure within the crankcase 8 is lowered to increase the inclination of the swash plate 10. As a result, the length of stroke of the piston 7 is increased to increase the delivery quantity or capacity of the compressor. In the meantime, the one spherical end 43*a* of the rod 43 slides along the guide groove 10*f* to the other end of the same.

When the piston 7 is in linear reciprocating motion, the swash plate 10 always undergoes compression reaction forces from the compressing pistons 7, i.e. forces of the pistons 7 during the compression stroke acting to push the swash plate as well as tensile reaction forces from the suction pistons 7, i.e. forces of the pistons during the suction stroke acting to pull the swash plate 10.

When the piston 7 i.e. its shoe 50 slides on the swash plate 10 from a top dead center position portion thereof to a bottom dead center position portion of the same as the swash plate 10 rotates about the drive shaft 5, the piston 7 is pulled by the retainer 53 toward the front head 4, while the shim 70 received in the recess 71 formed in the retainer 53 is pressed against the retainer support member 55.

The shim 70 pressed against the retainer support member 55 slides (or rotates) with respect to the retainer support member 55 rotating in unison with the swash plate 10.

As a result, the shim 70 slidingly rotates at a speed lower than rotational speed of the drive shaft 5.

On the other hand, the retainer 53 does not rotates in unison with the swash plate 10 as the drive shaft 5 rotates, but slides or rotates with respect to the shim 70.

That is, the shim 70 slides or rotates with respect to both the retainer 53 and the retainer support member 55 whereby the speed of sliding of the retainer support member 55 on the retainer 53 can be relatively decreased or cushioned. More specifically, it can be divided into two lower components, i.e. a lower speed of the sliding of the shim 70 on the retainer 53 and a lower speed of the sliding of the shim 70 on the retainer support member 55.

The embodiment of the invention provides the following advantageous effects:

Firstly, since the speed of sliding of the retainer support member 55 on the retainer 53 is cushioned, i.e. decomposed into the lower components as described above, it is possible to reduce abrasion of the retainer 53 to thereby prevent noises from being produced e.g. by collision between the retainer 53 and the retainer support member 55 when each piston 7 reciprocates within the cylinder bore 6.

Secondly, since the shim 70 is received within the recess 71 formed in the retainer 53, it is not required to align the shim 70 with the retainer 53 when the shim 70 is mounted.

Thirdly, the shim 70, which is formed simply by blanking a steel plate, is thinner and less expensive than a thrust bearing which could be used similarly to the shim 70, for decreasing or cushioning the speed of sliding of the retainer support member 55 on the retainer 53. Therefore, the compressor can be designed to be smaller in size and weight by using the shim 70 than when the thrust bearing is employed in place of the shim 70.

Fourthly, if the shim 70 to manufactured of a steel plate having a high quality surface, it is possible to dispense with surface treatment of the shim 70, which contributes to reduction of the manufacturing cost of the same.

Fifthly, if each shoe gap (i.e. a gap between a bottom surface 51*a* of the first support member 51 of the shoe 50 and the sliding surface 10*a* of the swash plate 10) is set to a predetermined uniform value by the use of shoes 50 having the same thickness, and then a seemingly suitable shim 70 is selected out of a plurality of shims 70 different in thickness so as to adjust the shoe gaps, the adjustment of the shoe gaps can be effected at one location, which is conventionally carried out at a location of each of the shoes. As a result, the number of man-hours required for assembly of the compressor is decreased, which contributes to reduction of the manufacturing costs of the compressor.

For the adjustment of shoe gaps, it would be possible to prepare a plurality of retainers 53 different in thickness instead of using the shims 70. However, the retainer 53 is more expensive than the shim 70, so that the adjustment of shoe gaps by the use of the shim 70 is more advantageous in terms of the manufacturing costs of the compressor.

Figure 5:
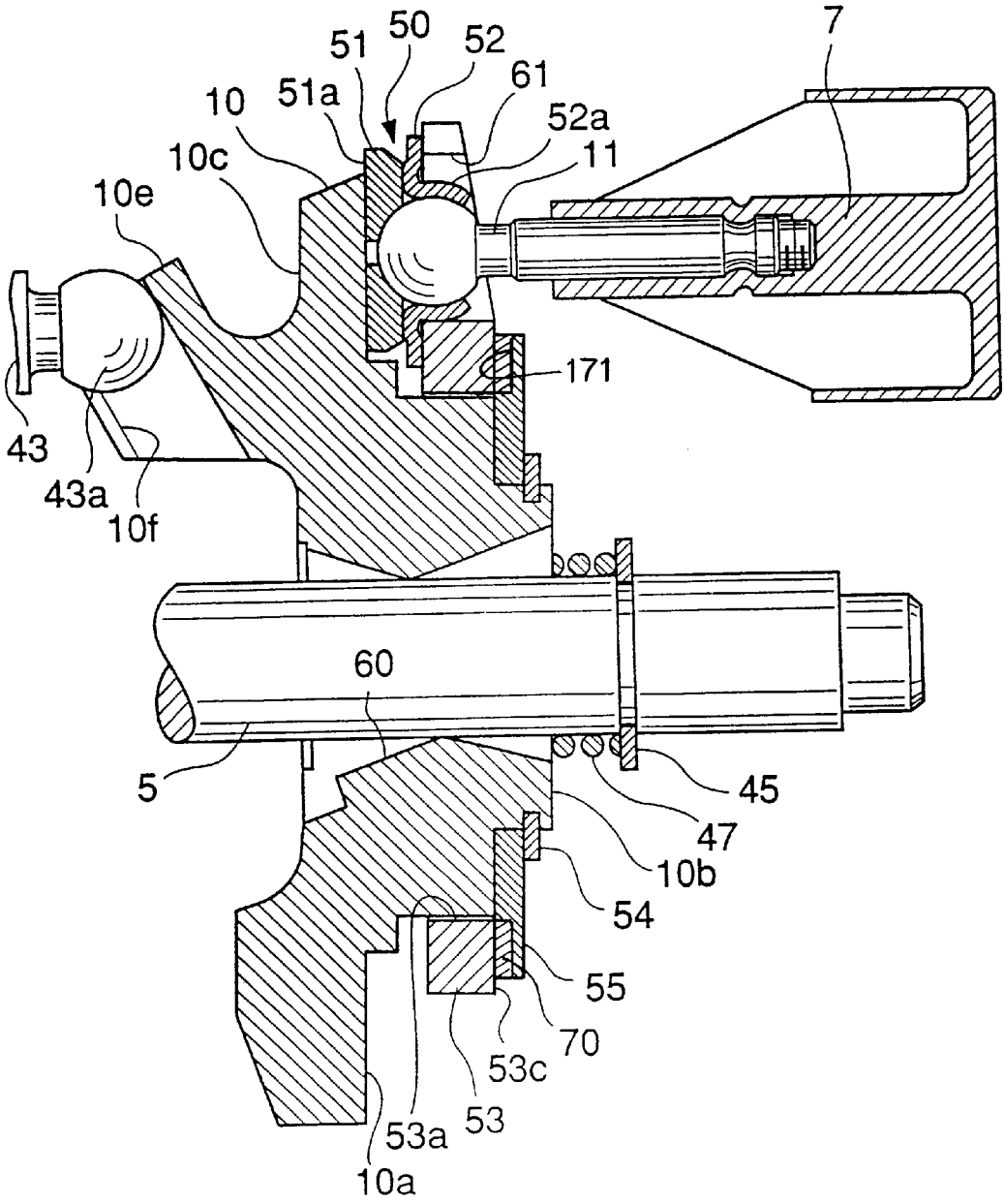
FIG. 5 is a longitudinal cross-sectional view, similar to FIG. 2, but showing a modified embodiment of the invention.

Although in the above embodiment, the recess 71 is formed in the retainer 53, this is not limitative, but the recess 71 may be formed in the retainer support member 55, as shown in FIG. 5, or in both of the retainer 53 and the retainer support member 55, as well.

Further, the shim 70 may be interposed between the retainer 53 and the retainer support member 55 in a sandwiched manner, instead of being received in the recess 71 formed in the retainer 53. In this case, however, it is required to align the shim 70 with the retainer 53 when they are assembled.

Still further, although in the above embodiment, description is made of a case in which the invention is applied to a variable capacity swash plate compressor, this is not limitative, but the invention may be applied to a fixed capacity swash plate compressor.

It is further understood by those skilled in the art that the foregoing is the preferred embodiment and variations of the invention, and that various changes and modifications may be made without departing from the spirit and scope thereof.

What is claimed is:

1. In a swash plate compressor including a drive shaft, a rotating member rigidly fitted on said drive shaft, for rotation in unison with said drive shaft as said drive shaft rotates, a swash plate mounted on said drive shaft in an inclined manner with respect to an imaginary plane perpendicular to said drive shaft, said swash plate having a sliding surface and rotating in unison with said rotating member as said rotating member rotates, a plurality of shoes each arranged on said sliding surface of said swash plate, for relative rotation with respect to a circumference of said swash plate as said drive shaft rotates, a retainer mounted on said swash plate in a relatively rotatable manner with respect to said swash plate, for retaining said shoes, and a retainer support member rigidly fitted on said swash plate, for slidably supporting said retainer, the improvement comprising:

a sliding plate interposed between said retainer and said retainer support member said sliding plate being in contact with both of said retainer and said retainer support member, and said sliding plate being slidable with respect to both of said retainer and said retainer support member.

2. A swash plate compressor according to claim 1, wherein at least one of said retainer and said retainer support member has a recess for receiving said sliding plate therein.

3. A swash plate compressor according to claim 1, wherein said sliding plate comprises a metal member formed by blanking.

4. A swash plate compressor according to claim 2, wherein said sliding plate comprises a metal member formed by blanking.

5. A swash plate compressor according to claim 2, wherein said retainer has said recess formed therein.

6. A swash plate compressor according to claim 5, wherein:

said retainer is in the form of an annular disk having a retainer support member-side end face, and said recess is annularly formed in said retainer support member-side end face along an inner periphery thereof.

7. A swash plate compressor according to claim 6, wherein said recess has a diameter substantially as large as an outer diameter of said sliding plate and a depth substantially as large as a thickness of said sliding plate.

8. A swash plate compressor according to claim 1, wherein said sliding plate is formed of a ferrous material.

9. A swash plate compressor according to claim 2, wherein said sliding plate is formed of a ferrous material.

10. A swash plate compressor according to claim 2, wherein said retainer support member has said recess formed therein.

* * * * *